US009346303B2

(12) United States Patent
Grinberg et al.

(10) Patent No.: US 9,346,303 B2
(45) Date of Patent: May 24, 2016

(54) SYSTEM AND METHOD TO APPLY TOPPING MATERIALS TO PRINT PRODUCTS

(75) Inventors: Eli Grinberg, Pardesia (IL); Kobi Bar, Kfar Saba (IL)

(73) Assignee: SCODIX LTD, Rosh Ha'ain (IL)

( * ) Notice: Subject to any disclaimer, the term of this patent is extended or adjusted under 35 U.S.C. 154(b) by 0 days.

(21) Appl. No.: 13/261,223

(22) PCT Filed: Oct. 1, 2010

(86) PCT No.: PCT/IB2010/002671

§ 371 (c)(1), (2), (4) Date: Mar. 21, 2012

(87) PCT Pub. No.: WO2011/077200

PCT Pub. Date: Jun. 30, 2011

(65) Prior Publication Data

US 2012/0269983 A1 Oct. 25, 2012

Related U.S. Application Data

(60) Provisional application No. 61/282,136, filed on Dec. 22, 2009.

(51) Int. Cl.

| | |
|---|---|
| ***B05D 5/10*** | (2006.01) |
| ***B41M 3/00*** | (2006.01) |
| ***B41M 7/00*** | (2006.01) |
| ***B44C 1/18*** | (2006.01) |

(52) U.S. Cl.

CPC ..... *B41M 3/006* (2013.01); *B41M 7/0045* (2013.01); *B41M 7/0081* (2013.01); *B44C 1/18* (2013.01); *B41M 7/0072* (2013.01)

(58) Field of Classification Search

CPC ..... B05D 2401/32; B05D 5/06; B05D 3/067; B05D 3/06; D06P 1/44; D04H 11/00; B41M 7/0027; B41M 5/5218

USPC ..... 427/202, 204, 206, 508, 510, 512, 514, 427/288, 265, 261

See application file for complete search history.

(56) References Cited

U.S. PATENT DOCUMENTS

| | | | | |
|---|---|---|---|---|
| 6,641,629 | B2 * | 11/2003 | Safta et al. | 51/298 |
| 7,465,473 | B2 * | 12/2008 | Stevenson et al. | 427/202 |

FOREIGN PATENT DOCUMENTS

| | | | |
|---|---|---|---|
| EP | 0657309 | * | 6/1995 |
| EP | 0657309 | A1 | 6/1995 |
| WO | 99/65699 | * | 6/1999 |
| WO | 99/65699 | * | 12/1999 |
| WO | WO9965699 | | 12/1999 |

* cited by examiner

*Primary Examiner* — Xiao Zhao

(74) *Attorney, Agent, or Firm* — Manelli Selter PLLC; Edward J. Stemberger

(57) ABSTRACT

Disclosed are systems and methods, including a method that includes depositing a curable adhesive onto a first surface of a substrate in a pre-determined pattern, placing topping material onto the substrate with the deposited adhesive, and applying UV energy to the substrate including the deposited adhesive and the placed topping material to cause curing of the deposited adhesive.

9 Claims, 5 Drawing Sheets

SYSTEM AND METHOD TO APPLY TOPPING MATERIALS TO PRINT PRODUCTS

CROSS-REFERENCE TO RELATED APPLICATION

The present application claims priority to International Patent Application No. PCT/IB2010/002671 (PCT Publication No. WO2011/077200), filed Oct. 1, 2010, and entitled "SYSTEM AND METHOD TO APPLY TOPPING MATERIALS TO PRINT PRODUCTS", which claims priority to U.S. Provisional Patent Application 61/282,136, filed Dec. 22, 2009, and entitled "METHOD OF APPLYING GLITTER TO A SUBSTRATE", the disclosures of which are incorporated herein by reference in their entireties.

FIELD OF THE INVENTION

The present invention relates to placing topping materials on top of printed material.

BACKGROUND

The present disclosure is directed to producing print products (e.g., cards, printed literature, etc.), and more particularly to a system and method to apply topping materials, for example, glitter materials, to print products.

Glitter, metallic and glass powders that reflect light are widely used for decorative applications such as posters, birthday cards and the like. Conventionally, a self-drying, water based, plastic adhesive is silk screened or rolled onto a substrate, glitter powder is poured, and the substrate is then tipped and shaken and/or vacuumed to remove excess glitter. Such techniques tend to result in low resolution print products.

SUMMARY

In some embodiments, the present disclosure is directed to providing a method for applying glitter to a substrate, including digitally printing an adhesive onto the substrate to form a pattern, pouring glitter over the substrate and adhering the glitter to the pattern, exposing glitter coated adhesive to pattern to UV light, and removing excess glitter.

Optionally, removal of excess glitter comprises at least one of the group consisting of vacuuming, tipping and tamping the substrate. Optionally, the procedures implemented may include pressing the glitter into the adhesive pattern layer using, for example, a roller or plate.

Optionally the procedures implemented may include applying an over-layer of polymer onto the glitter layer. Optionally, the glitter layer includes particles of adhesive. Typically the over-layer is applied by a technique selected from the group consisting of digital printing, lamination, silk screening, brushing and rolling. In some embodiments, the over layer is a thermoset that is cured by exposure to UV light.

In some embodiments, a decorated substrate comprising a layer of glitter applied to a substrate with a digitally printed UV curable adhesive is provided.

The systems and methods described herein are advantageous over conventional systems and methods for adding topping materials (e.g., glitter) to media in that by using, for example, the UV cured thermoset adhesives the glitter better adheres to the adhesive and/or substrate than with regular water based glues. Where a sealing layer is applied onto the glitter layer, the results are further improved.

Thus, in one aspect, a method is disclosed. The method includes depositing a curable adhesive onto a first surface of a substrate in a pre-determined pattern, placing topping material onto the substrate with the deposited adhesive, and applying UV energy to the substrate including the deposited adhesive and the placed topping material to cause curing of the deposited adhesive.

Embodiments of the method may include any of the features described in the present disclosure, including any of the following features.

The topping material may be a glitter material.

The method may further include removing excess topping material not adhered to the deposited adhesive by performing one or more of, for example, vacuuming the excess topping material, tipping the substrate in order to cause at least some loose non-adhered topping material be removed, and/or tamping the substrate.

The method may further include facilitating adhesion of the topping material to the deposited adhesive by performing one or more of, for example, a) placing topping material comprising melted powder with solid powder, b) applying a magnetic field under the substrate to cause metallic-based topping material to be subjected to a magnetic force directed towards the substrate, c) applying air pressure onto the first surface of the substrate including the deposited adhesive and the placed topping material, d) generating an electrostatic field under the substrate to cause metallic-based topping material to be subjected to a magnetic force directed towards the first surface of the substrate, e) pressing the placed topping material to the adhesive deposited on the substrate using one or more nipping rollers, and/or f) using and curing exothermal adhesives to cause the release of heat from the exothermal adhesive to melt the topping material.

The method may further include applying an over-layer of polymer onto a layer of the placed topping material. The over-layer may be applied by a technique selected from the group consisting of digital printing, lamination, silk screening, brushing and rolling. The over-layer may be a thermoset that is cured by exposure to the applied UV energy.

Depositing the adhesive may include digitally printing the curable adhesive using a digital inkjet.

The method may further include pre-curing the curable adhesive to initiate the curing process of the adhesive and manipulate a viscosity level of the curable adhesive.

The method may further include applying infrared energy to the substrate including the deposited adhesive and the placed topping material.

The curable adhesive may include one or more of, for example, a radical type adhesive and a cationic adhesive.

The method may further include removing contaminants prior to the placing of the topping material by performing one or more of, for example, vacuuming the contaminants, tipping the substrate in order to cause at least some of the contaminants to be removed, and/or tamping the substrate.

In another aspect, a system is disclosed. The system includes an adhesive depositing machine to deposit a curable adhesive onto a first surface of a substrate in a pre-determined pattern, a placement device to place topping material onto the substrate with the deposited adhesive, and a UV energy source to apply UV energy to the substrate including the deposited adhesive and the placed topping material to cause curing of the deposited adhesive.

Embodiments of the system may include any of the features described in the present disclosure, including any of the features described above in relation to the method and the features described below, including any one of the following features.

The system may further include one or more devices to facilitate adhesion of the topping material to the deposited adhesive by performing one or more of, for example, a) placing topping material comprising melted powder with solid powder, b) applying a magnetic field under the substrate to cause metallic-based topping material to be subjected to a magnetic force directed towards the substrate, c) applying air pressure onto the first surface of the substrate including the printed adhesive and the placed topping material, d) generating an electrostatic field under the substrate to cause metallic-based topping material to be subjected to a magnetic force directed towards the substrate, e) pressing the placed topping material to the adhesive deposited on the substrate using one or more nipping rollers, and/or f) using and curing exothermal adhesives to cause the release of heat from the exothermal adhesive to melt the topping material.

The UV energy source may includes one or more of, for example, a UV fluorescent lamp, a UV LED device, and a UV laser devices.

The system may further include a topping material removal unit to remove excess topping material not adhered to the deposited adhesive by performing one or more of, for example, a) vacuuming the excess topping material, b) tipping the substrate in order to cause at least some loose non-adhered topping material be removed, and/or c) tamping the substrate.

The system may further include another energy source to pre-cure the curable adhesive to initiate the curing process of the adhesive and manipulate a viscosity level of the curable adhesive.

The system may further include an infrared energy source to apply infrared energy to the substrate including the deposited adhesive and the placed topping material.

The adhesive depositing machine may include a digital inkjet to digitally print the curable adhesive.

The details of one or more variations of the subject matter described herein are set forth in the accompanying drawings and the description below. Other features and advantages of the subject matter described herein will be apparent from the description and drawings, and from the claims.

BRIEF DESCRIPTION OF THE DRAWINGS

These and other aspects will now be described in detail with reference to the following drawings.

Like reference symbols in the various drawings indicate like elements.

DETAILED DESCRIPTION

Disclosed are systems, machines, devices and methods, including a method for depositing a curable adhesive onto a first surface of a substrate in a pre-determined pattern, placing topping material onto the substrate with the deposited adhesive, and applying UV energy to the substrate including the deposited adhesive and the placed topping material to cause curing of the deposited adhesive. In some embodiments, to further harden the adhesive, other types of energy, including infrared energy (from the same source producing the UV energy or a different source) may be used.

Also disclosed is a system that includes an adhesive depositing machine to deposit a curable adhesive onto a first surface of a substrate in a pre-determined pattern, a placement device to place topping material onto the substrate with the deposited adhesive, and a UV energy source (which may include, for example, a UV fluorescent lamp, a UV LED device, a UV laser device, a gas-discharge lamp, etc.) to apply UV energy to the substrate including the deposited adhesive and the placed topping material to cause curing of the deposited adhesive.

As used herein, the term 'Inkjet Printing' or 'Inkjetting' refers hereinafter to an adaptation of the conventional technology developed for the deposition of ink onto paper, including: thermal inkjets, piezoelectric inkjets and continuous inkjets, as a mechanism for the deposition of various materials in liquid form, including adhesive, onto a substrate. An inkjet can include, for example, a conventional an inkjet printer, a toner-based printer, a silk screen printer and/or a lithography-based printer.

The term 'nipping' refers hereinafter to the action of tightly holding or squeezing at least two items together.

The term 'curing' refers hereinafter to the toughening or hardening of a polymer material by cross-linking of polymer chains, brought about by procedures that include, for example, procedures based on use of chemical additives, ultraviolet radiation, electron beam (EB), heat, etc.

Figure 1:
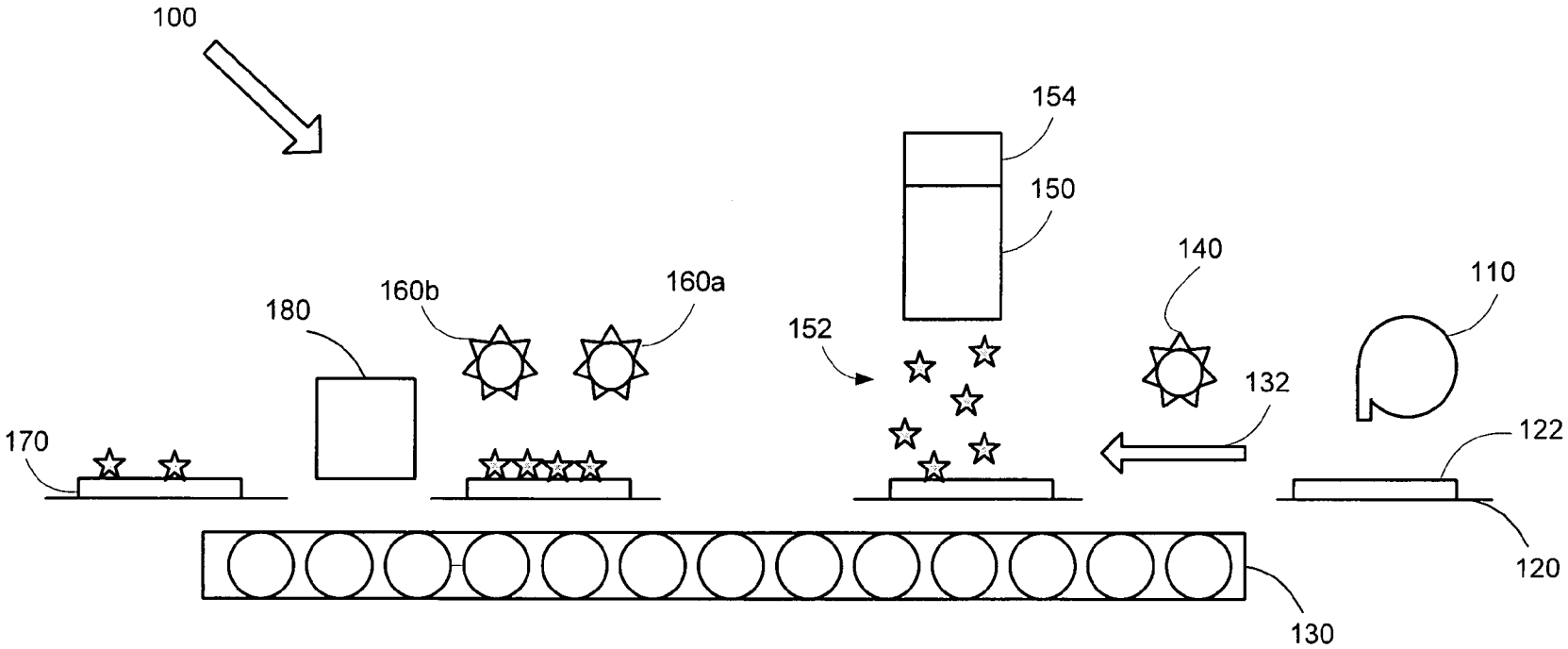
FIG. 1 is a schematic diagram of an example system to produce print products.

With reference to FIG. 1, a schematic diagram of system 100 to produce print products, including print product to which topping materials (such as glitter) are added is shown. The system 100 includes an adhesive depositing section 110 which may include, in some implementations, a digital printing device 110 (e.g., an inkjet printer) to digitally deposit is some pre-determined pattern deposit material composed of a layer of adhesive 122, generally having a thickness of about 1 to 200 microns, onto a first (e.g., top) surface of a substrate 120. Other types of depositing printing devices that may be used include, for example, a toner-based printer, a silk screen printer, a lithography-based printer, etc. When deposited on the substrate 120, the adhesive layer 122 may be tacky or non-tacky. A conveyer belt 130 advances the adhesive-topped substrate (which, as noted, may be patterned) in a direction indicated by an arrow 132.

In some embodiments, the adhesive may include a radical type adhesive, a cationic adhesive, etc. Such adhesives may include, for example, photo polymeric adhesives. Further details about procedures to deposit/print adhesives are provided in, for example, U.S. patent application Ser. No. 12/721,234, entitled "A System and Method for Cold Foil Relief Production," the content of which is hereby incorporated by reference in its entirety.

The substrate 120 may be constructed from a material composition including, for example, metal, plastic, paper, glass, non-woven fabric, methacrylic copolymer resin, polyester, polycarbonate and polyvinyl chloride, plastic, paper, glass, non-woven fabric, methacrylic copolymer resin, polyester, polycarbonate, polyvinyl chloride, etc. The substrate 220 may be in sheet form or roll form and may be rigid or flexible.

In some embodiments, the structure comprising the substrate 120 and the curable adhesive 122 may be exposed to energy applied from a first, optional, energy source 140 located upstream of a placement device to add the topping material to the substrate with the deposited adhesive, thus initiating the curing of the adhesive 122 and manipulating (regulating) the adhesive's viscosity. The pre-curing process, which may be controlled by the composition of the adhesive, the energy source used, and the manner in which energy is applied, may initiate the curing process. During the curing process, the adhesive may or may not become tacky. After adding a topping material, such as glitter, the adhesive is cured to cause it to become substantially tacky and thus to cause added materials, such as glitter to substantially adhere to the deposited adhesive.

In some embodiments, the adhesive has an initial viscosity of 10 cps (centipoise). In some embodiments, the energy source 140 may be a radiation source, such as a ultraviolet source, emitting UV radiation onto the curable adhesive 122 to initiate the curing process. Examples of UV radiation sources that may be used as the UV energy source 140, or as any of the UV sources of the system 100 and 200 described herein, include, for example a UV fluorescent lamp, a UV LED device, a UV laser device, etc. Partial curing performed on the adhesive, e.g., to initiate the curing, causes the polymerization of the material to start so that the adhesive starts to change its phase from liquid to solid. In some embodiments, the energy source 140 may be, for example, an infrared source, a lamp generating incoherent optical radiation, a laser source, a gas-discharge lamp, an electron beam generator, a heating element, etc. Other types of energy sources may be used.

The structure including the adhesive-topped substrate (with or without having the adhesive 122 exposed to the upstream energy source 140 to initiate the curing process) advances to a placement/topping station in which topping material, such as glitter, some other metallic-based material, etc., is placed onto the substrate with the curable adhesive. In some embodiments, the placement station may include a placement device 150 (which may be a sprinkling device, a spraying device, a jetting device, etc.) that sprinkles (or pours, or otherwise disposes) topping material 152, such as glitter, onto the substrate on which an adhesive was deposited in some pre-determined pattern. The topping material may be stored in a topping material source/reservoir 154. When the topping material is placed on the adhesive, it may start to adhere to the adhesive deposited on the substrate (depending on the adhesive's level of adhesiveness and how tacky the adhesive is).

In some embodiments, the placed particles of the topping material may be placed with sufficient energy so that at least a portion of the topping material's particles can penetrate the deposited adhesive/glue layer and be embedded therein. The energy of the placed particles may be provided from their gravitational fall towards the substrate, or through an initial thrust given to the topping material by way of a sprinkling device, a spraying device, a jetting device, etc., to place the topping material on the substrate with the deposited adhesive.

In some embodiments, the topping material 152 may be provided in the form of powder, including colored powder, that can adhere to the adhesive material once the adhesive material is cured. Thus, for example, to produce print products that include raised colored features (e.g., text), the adhesive is deposited to form a patterned adhesive layer of some pre-determined thickness (e.g., 120 micron), and color powder may then be sprinkled from a sprinkling device such as the placement device 150. Subsequently, the substrate with the colored raised features is subjected to an energy from an energy source to cause curing and/or hardening of the adhesive.

With the placed glitter (or some other topping material) disposed on the substrate with the deposited curable adhesive, the substrate is advanced to a curing/heating station that may include one or more energy sources, such as the UV energy sources 160*a* and 160*b* to perform the curing process of the adhesive 122 (on which the topping material was placed). In the implementations depicted in FIG. 1 the one or more energy sources include two energy sources (e.g., arranged to define an array of energy sources) that may be arranged in configurations to enable particular energy distribution patterns.

During the curing process, the topping material adheres to the gradually hardening adhesive. As a result of the curing process, topping materials that were in contact with the pattern of deposited adhesive on the substrate will be substantially secured to the hardening adhesive, while topping materials that were spread over areas of the surface of the substrate that did not include an adhesive will not bind or otherwise become secured to the structure that includes the substrate and the patterned deposited adhesive. Consequently, by removing excess topping material from the substrate, generally only topping materials bound to the adhesive during the initial placement of the topping materials and the curing process will remain on the substrate, resulting in the print product 170. Removing excess topping materials, e.g., at a removal station 180, may be performed by one or more of, for example, a) vacuuming the excess topping material, b) tipping the substrate in order to cause at least some loose non-adhered topping material be removed, and c) tamping the substrate to cause excess topping material to be shaken off.

Further processing on the finished product 170 may be performed.

In some embodiments, removal of topping material particles, other contaminants (e.g., dust), etc., may be performed prior to one or more of the adhesive depositing stage, and/or the pre-curing stage. Thus, for example, prior to depositing curable adhesive (e.g., by a printing device), the substrate may undergo a procedure of removing/cleaning particles, including topping particles, contaminants, etc., by performing, for example vacuuming of the substrate, tipping the substrate to cause at least some loose particles to be removed, tamping the substrate to cause such particles to be removed, etc. As noted, similar particle removal procedures can also be performed prior to the pre-curing process (e.g., before topping material is placed on the substrate).

In some embodiments, the system 100 may also include one or more other sources of energy, such as for example, infrared energy sources. In such embodiments, the substrate with the topping material disposed on the deposited adhesive is also subjected, in addition to UV energy that causes curing of the curable adhesive, to infrared radiation that heats the structure of the substrate, adhesive and topping material. This additional source of energy may expedite the hardening process, cause melting of the topping material, etc. Thus, for example, in some embodiments, the energy source 160*a* of FIG. 1 may be a UV energy source, whereas the energy source 160*b* may be an infrared source. In some embodiments, an energy source may produce radiation that includes a UV radiation component and an infrared radiation component (and/or additional radiation components) that are then directed to the substrate to facilitate the process of forming print products such as the print product 170.

Figure 2:
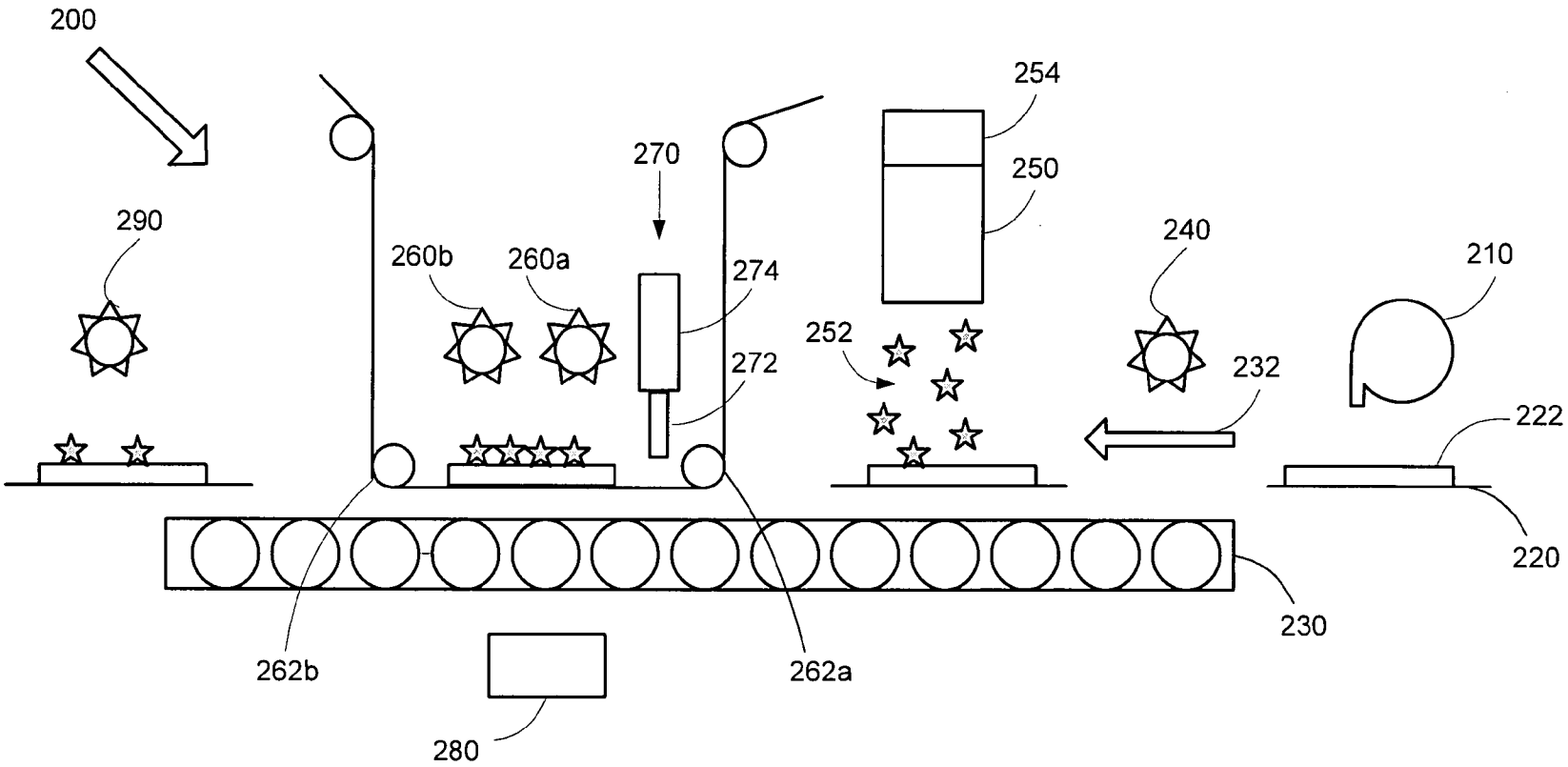
FIG. 2 is a schematic diagram of another example system to produce print products.
Figure 3:
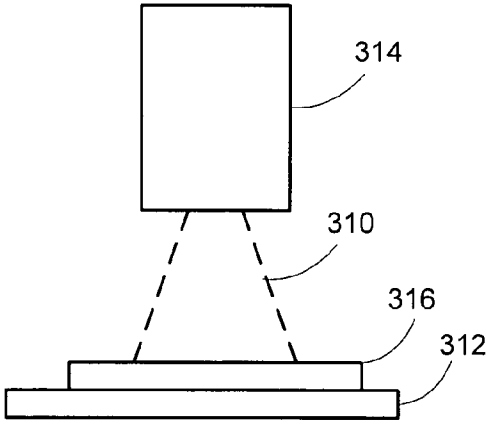
FIGS. 3-6 are schematic diagrams of additional systems to produce print products.

Referring now to FIG. 2, a schematic diagram of an example system 200 is shown. The system 200 is generally similar to the system 100 depicted in FIG. 1, and is thus generally configured to perform similar operations to those performed by the system 100. As such, the system 200 includes a depositing device such as a printing device 210 that may be similar to the printing device 110 and may include, for example, one or more of an ink jet, a toner-based printer, a silk screen printer, a lithography-based printer, etc. The printing device is configured to print (or deposit) a patterned layered of curable adhesive 222, having a composition that may be similar to the adhesive 122 of FIG. 1, on top of a substrate 220 (which may be similar to any of the substrate materials that may be used in conjunction with the system 100). An optional energy source 240 may be operated to apply energy onto the layered adhesive on top of the substrate 220 to cause the adhesive to become pre-cured. A placement station 250, similar to the placement station 150, places (e.g., sprinkles, spreads) topping material, such as glitter, over the substrate with the deposited adhesive.

In the implementations shown in FIG. 2, the system 200 may include one or more devices to facilitate adhesion of the topping material to the deposited adhesive. As shown in FIG. 2, two examples of devices that facilitate adhesions are a pressing assembly that includes one or more nip rollers (such as nip rollers 262*a* and 262*b*) and a pressure device 270. Particularly, in some implementations, the topping material disposed on the substrate-topped-adhesive is pressed against the adhesive using the nip roller 262*a*. As the substrate-adhesive-topping structure continues to advance (in a direction indicated by the arrow 232) through the pressing section (via, for example, a conveyor belt 230 which may be similar to the conveyor belt 130), it is subjected to energy from one or more energy sources 260*a* and 260*b* (which may be similar to any of the energy sources 140, 160*a*, 160*b* and 240 described herein). The energy, which may include a UV energy component, and may also include an infrared component, causes the adhesive 222 to undergo the curing process during which the adhesive and adheres to the substrate and to the topping material. The curing performed during the pressing also causes a substantial solidification of the topping-adhesive-substrate structure.

As further shown in FIG. 2, in some embodiments, the system 200 may also include the pressure device 270 configured to direct air, or some other gas or fluid, at the structure comprising the topping material-adhesive and substrate, to controllably press the topping material onto the adhesive (during, before, or after the curing process). The air pressure device includes a conduit 272, such as a pipe or a hose, connected at one end to an air source 274 (e.g., a pump or a high pressure tank) that directs air through the conduit 272 to the conduit's distal outlet. The conduit's outlet is positioned, for example, over the top surface of the substrate, and thus the application of the pressurized gas or liquid over the topping material disposed thereon causes a controllable level of force to be applied to the topping material-adhesive-substrate structure to thus improve the adhesion of the topping material to the substrate-adhesive portion of the structure.

Another example of a device to facilitate adhesion of the topping material to the substrate-adhesive structure is a magnetic device, such as the magnet 280 placed underneath the bottom surface of the substrate. The magnet 280 is configured to apply a magnetic field under the substrate to cause metallic-based topping materials to be subjected to a magnetic force directed towards the substrate, thus promoting adhesion between the topping material and the substrate-adhesive structure. Further ways to facilitate adhesion of the topping material to the substrate-adhesive structure include devices that perform one or more of:

a) placing topping material comprising melted powder with solid powder, b) generating an electrostatic field under the substrate to cause metallic-based topping materials to be subjected to a magnetic force directed towards the substrate, and c) using and curing exothermal adhesives to cause the release of heat from the exothermal adhesive to melt the topping material.

As with the implementations of FIG. 1, the system 200 may also include a topping removal station (not shown) to remove excess topping material that was not bound to the substrate-adhesive structure.

As further shown in FIG. 2, in some embodiments, the system 200 may also include additional energy sources, such as the source 290, which may be used to further facilitate the solidification and/or curing of the product that includes the substrate with the topping material arranged in a pattern based on the pattern of the deposited adhesive. Thus, procedures for applying topping materials may include various sequences of energy application, including, for example, a procedure in which the operations performed include depositing an adhesive, pre-curing the adhesive (using a first energy source), placing topping material (in powder or liquid form) on the adhesive, applying energy from an infrared (IR) source, applying energy from a UV source, and applying energy from another IR source.

Figure 4:
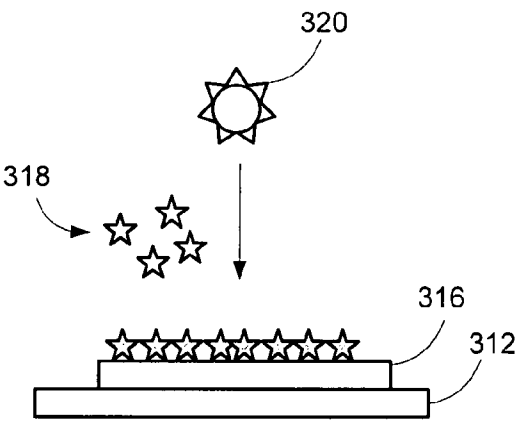

Further embodiments of systems to produce products with topping materials are illustrated in FIGS. 3-7. As shown, an adhesive 310 (which may similar to the adhesives 122 and 222 of FIGS. 1 and 2) is digitally printed (at 410 of FIG. 7) onto a substrate 312 using, for example, an ink jet printer 314 to form a pattern 316. As shown in FIG. 4, glitter material 318 is then poured (at 420 of FIG. 7) over the substrate 312 and, where placed on the adhesive, adheres, at least in part, to the adhesive. Exposing the structure to, for example, UV light from a lamp 320 (at 440 of FIG. 7) cures the adhesive and fastens the glitter powder 318 to the pattern 316. Excess Glitter is removed (at 450 of FIG. 7) by, for example, vacuuming (at 460 of FIG. 7) and/or by tipping (at 470 of FIG. 7), and optionally by tamping (at 480 of FIG. 7) the substrate 312.

Implementations as illustrated in FIGS. 1-7 offer higher resolution than conventional systems that include glitter application. Such implementations thus enable patterns having high precision and detail to be created.

Optionally, in some embodiments, the pattern 316 may have a thickness of the order of 50 microns so that glitter particles may be embedded therein (other thickness values, e.g., 1-500 microns, may be used). Optionally, and as noted above, the glitter may be pressed (at 430 of FIG. 7) into the digitally adhesive layer making up the pattern 316 using, for example, a roller or plate.

Figure 5:
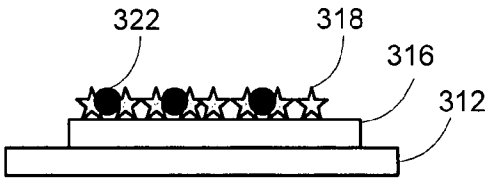

As shown in FIG. 5, in some embodiments, the glitter 318 may include glue particles 322 that melt when heat is applied, thereby binding and laminating the glitter in place.

Figure 6:
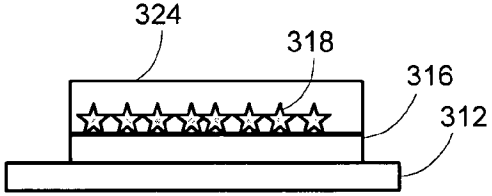
Figure 7:
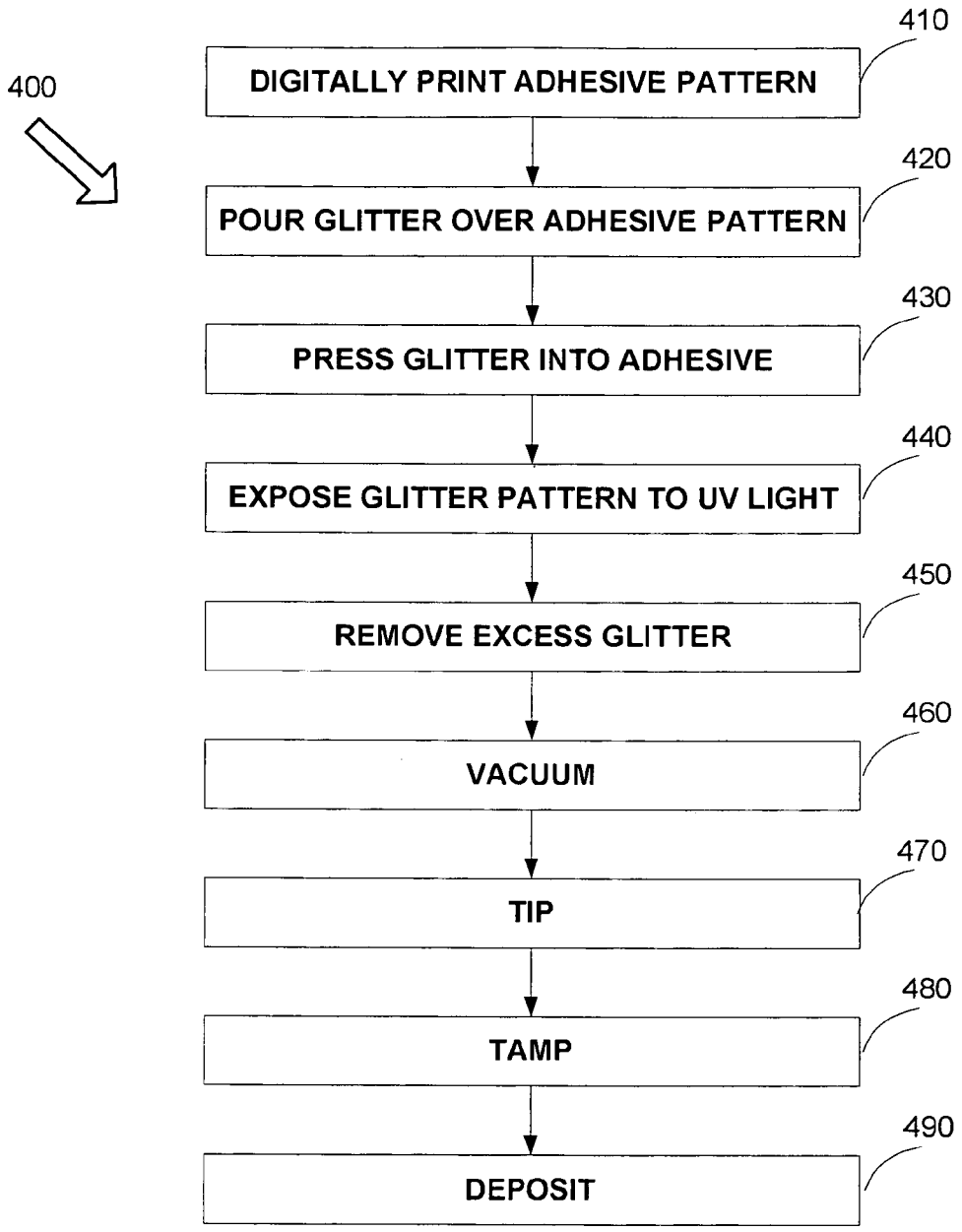
FIG. 7 is a block diagram of an example procedure to produce print products with applied topping materials.

With reference to FIG. 6, in some embodiments, a layer of clear polymer 324 is deposited (at 490 of FIG. 7) over the glitter layer 318. The layer of clear polymer 324 may be applied by digital printing, or may be brushed, silk screened or rolled on, or applied as a sheet and heat treated.

Figure 8:
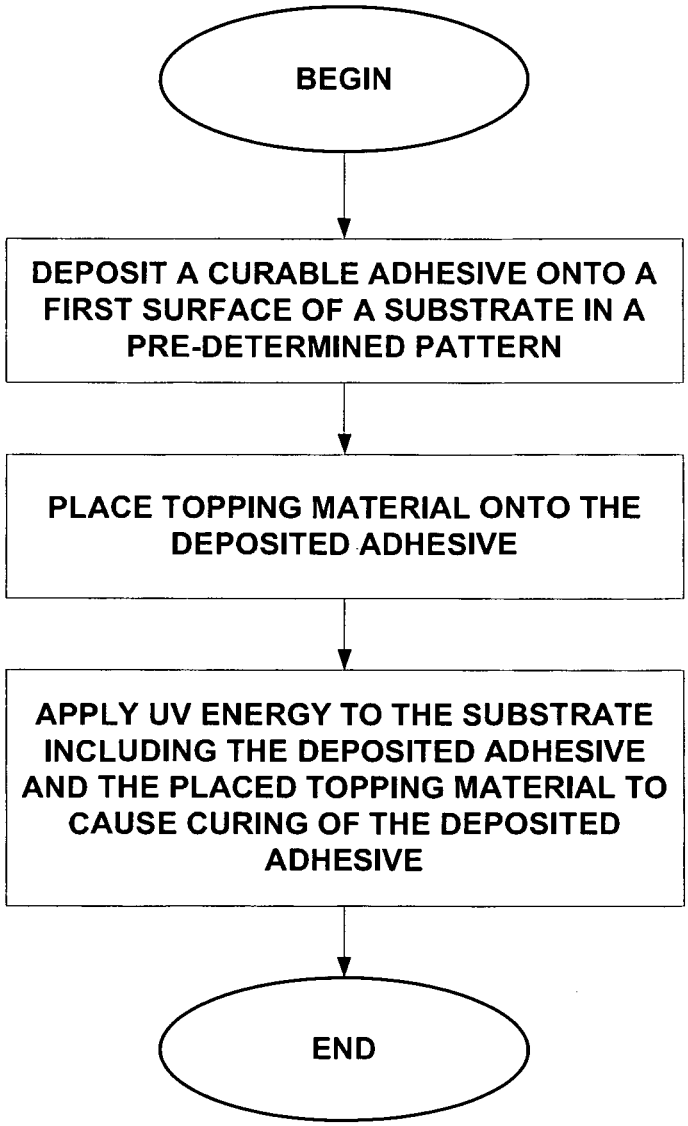
FIG. 8 is a flowchart of an example procedure to produce print products that include applied topping materials.

With reference to FIG. 8, a flowchart of a further embodiment of a procedure 500 to apply topping materials to print products is shown. The procedure 500 includes depositing 510 a curable adhesive onto a first surface of a substrate in a pre-determined pattern. Such depositing may be performed, for example, using a digital printer. Topping materials, such as glitter, is then placed 520 (e.g., sprinkled, poured, sprayed, jetted, or otherwise disposed) onto the deposited adhesive. UV energy is applied 530 to the substrate that includes the deposited adhesive and the placed topping material to cause curing of the deposited adhesive and the placed topping material.

At least some of the subject matter described herein may be implemented in digital electronic circuitry, in computer software, firmware, hardware, or in combinations of them. For example, controllers to control the application of adhesive to the substrate (e.g., by way of a digital printer), the placement of topping materials on the substrate-adhesive structure, etc., may be implemented using processor-based devices, digital electronic circuitry, etc. The subject matter described herein can be implemented as one or more computer program products, i.e., one or more computer programs tangibly embodied in non-transitory media, e.g., in a machine-readable storage device, for execution by, or to control the operation of, data processing apparatus, e.g., a programmable processor, a computer, or multiple computers. A computer program (also known as a program, software, software application, or code) can be written in any form of programming language, including compiled or interpreted languages, and it can be deployed in any form, including as a stand-alone program or as a module, component, subroutine, or other unit suitable for use in a computing environment. A computer program does not necessarily correspond to a file. A program can be stored in a portion of a file that holds other programs or data, in a single file dedicated to the program in question, or in multiple coordinated files (e.g., files that store one or more modules, subprograms, or portions of code). A computer program can be deployed to be executed on one computer or on multiple computers at one site or distributed across multiple sites and interconnected by a communication network.

Processors suitable for the execution of a computer program include, by way of example, both general and special purpose microprocessors, and any one or more processors of any kind of digital computer. Generally, a processor will receive instructions and data from a read-only memory or a random access memory or both. The essential elements of a computer are a processor for executing instructions and one or more memory devices for storing instructions and data. Generally, a computer will also include, or be operatively coupled to receive data from or transfer data to, or both, one or more mass storage devices for storing data, e.g., magnetic, magneto-optical disks, or optical disks. Media suitable for embodying computer program instructions and data include all forms of volatile (e.g., random access memory) or non-volatile memory, including by way of example semiconductor memory devices, e.g., EPROM, EEPROM, and flash memory devices; magnetic disks, e.g., internal hard disks or removable disks; magneto-optical disks; and CD-ROM and DVD-ROM disks. The processor and the memory can be supplemented by, or incorporated in, special purpose logic circuitry.

At least some of the subject matter described herein may be implemented in a computing system that includes a back-end component (e.g., a data server), a middleware component (e.g., an application server), or a front-end component (e.g., a client computer having a graphical user interface or a web browser through which a user can interact with an implementation of the subject matter described herein), or any combination of such back-end, middleware, and front-end components. The components of the system can be interconnected by any form or medium of digital data communication, e.g., a communication network. Examples of communication networks include a local area network ("LAN") and a wide area network ("WAN"), e.g., the Internet.

The computing system may include clients and servers. A client and server are generally remote from each other in a logical sense and typically interact through a communication network. The relationship of client and server may arise by virtue of computer programs running on the respective computers and having a client-server relationship to each other.

A number of embodiments have been described. Nevertheless, it will be understood that various modifications may be made without departing from the spirit and scope of the invention. Accordingly, other embodiments are within the scope of the following claims.

What is claimed is:

1. A method consisting of:

a. depositing a curable adhesive onto a first surface of a substrate in a pre-determined pattern;

b. placing topping material onto the substrate with the deposited adhesive, said topping material comprising melted powder with solid powder; and c. applying UV energy to the substrate including the deposited adhesive and the placed topping material to cause curing of the deposited adhesive.

2. The method of claim 1, wherein depositing the adhesive comprises:

digitally printing the curable adhesive using a digital inkjet.

3. The method of claim 1, wherein the curable adhesive includes one or more of: a radical type adhesive and a cationic adhesive.

4. A method consisting of:

a. depositing a curable adhesive onto a first surface of a substrate in a pre-determined pattern;

b. placing topping material onto the substrate with the deposited adhesive, said topping material comprising melted powder with solid powder;

c. applying an over-layer of polymer onto a layer of the placed topping material; and d. applying UV energy to the substrate including the deposited adhesive and the placed topping material to cause curing of the deposited adhesive.

5. The method of claim 4, wherein the over-layer is applied by a technique selected from the group consisting of digital printing, lamination, silk screening, brushing and rolling.

6. The method of claim 4, wherein the over-layer is a thermoset that is cured by exposure to the applied UV energy.

7. A method consisting of:

a. depositing a curable adhesive onto a first surface of a substrate in a pre-determined pattern;

b. placing topping material onto the substrate with the deposited adhesive, said topping material comprising a glitter material; and c. applying UV energy to the substrate including the deposited adhesive and the placed topping material to cause curing of the deposited adhesive.

8. A method consisting of:

a. depositing a curable adhesive onto a first surface of a substrate in a pre-determined pattern;

b. placing topping material onto the substrate with the deposited adhesive, said topping material comprising melted powder with solid powder;

c. applying UV energy to the substrate including the deposited adhesive and the placed topping material to cause curing of the deposited adhesive; and d. removing excess topping material not adhered to the deposited adhesive by performing one or more of: i) vacuuming the excess topping material, ii) tipping the substrate in order to cause at least some loose non-adhered topping material be removed, and iii) tamping the substrate.

9. A method consisting of:

a. depositing a curable adhesive onto a first surface of a substrate in a pre-determined pattern;

b. removing contaminants by performing one or more of: i) vacuuming the contaminants, ii) tipping the substrate in order to cause at least some of the contaminants to be removed, and iii) tamping the substrate;

c. placing topping material onto the substrate with the deposited adhesive, said topping material comprising melted powder with solid powder; and d. applying UV energy to the substrate including the deposited adhesive and the placed topping material to cause curing of the deposited adhesive.

* * * * *